US005839672A

United States Patent [19]

Zarogatsky et al.

[11] Patent Number: 5,839,672

[45] **Date of Patent: *Nov. 24, 1998**

[54] CRUSHING PROCESS

[75] Inventors: Leonid P. Zarogatsky; Vladimir Ya. Turkin, both of St. Petersburg, Russian Federation

[73] Assignee: Rustec, Inc., Camden, N.J.

[ * ] Notice: This patent issued on a continued prosecution application filed under 37 CFR 1.53(d), and is subject to the twenty year patent term provisions of 35 U.S.C. 154(a)(2).

[21] Appl. No.: 653,293

[22] Filed: May 24, 1996

[51] Int. Cl.[6] ..... B02C 1/06

[52] U.S. Cl. ..... 241/30; 241/266

[58] Field of Search ..... 241/30, 264–269

[56] References Cited

U.S. PATENT DOCUMENTS

| | | | |
|---|---|---|---|
| 2,707,081 | 4/1955 | Schmidtmann | 241/266 |
| 2,999,651 | 7/1961 | Ault et al. . | |
| 3,465,976 | 9/1969 | Vinitsky et al. . | |
| 3,603,515 | 9/1971 | Lohmann et al. | 241/266 X |
| 4,588,137 | 5/1986 | McConnell, Jr. . | |
| 4,756,483 | 7/1988 | McConnell, Jr. . | |
| 4,936,520 | 6/1990 | Genev . | |

FOREIGN PATENT DOCUMENTS

| | | | |
|---|---|---|---|
| 1607610 | 8/1969 | Germany | 241/266 |
| 1165447 | 7/1985 | U.S.S.R. | 241/266 |

*Primary Examiner*—Mark Rosenbaum

*Attorney, Agent, or Firm*—Law Offices of Jane Massey Licata

[57] ABSTRACT

A process for crushing materials by feeding materials to be crushed between two crushing jaws which have a crushing force controlled by a resilient ties capable of providing synchronous vibration of each crushing jaw with respect to each other is provided.

3 Claims, 2 Drawing Sheets

CRUSHING PROCESS

FIELD OF THE INVENTION

The present invention provides a process for crushing materials wherein the materials to be crushed are fed between two crushing jaws, said crushing jaws having a crushing force controlled by a means capable of providing synchronous vibration of each crushing jaw.

BACKGROUND OF THE INVENTION

The movable jaw or jaws of conventional vibratory crushers generally move in a pendular motion with an amplitude dependent upon the eccentricity of the drives. The product size is determined by feed size and discharge clearance. However, the reduction ratio of these crushers typically only ranges between 4 and 5 because their design does not make it feasible to set the discharge clearance close to the thickness of the compressed material layer. In the case of continuous feed crushers, when the jaws move toward each other, their motion results in a crushing action and in a gravity discharge of the crushed material as the jaws move away from each other. Thus, the processing indices of the crushing process are limited by kinematic specifics of the drive and the crusher design.

Accordingly, a number of different vibrating jaw crushers have been designed with different drives and designs in an attempt to overcome limitations on the crushing process.

For example, U.S. Pat. No. 4,936,520 describes a vibrating jaw crusher having a simplified design which provides for uniform loading of the working plates. This design overcomes some of the problems of non-uniform loading of the crushing plates in the crushing of concrete blocks, building panels and other materials of flat shape which have a substantial weight which has negative results on the wear resistance of the working surfaces and on the energy consumption for the crushing per unit of material. The jaw crusher described in U.S. Pat. No. 4,936,520 comprises one movable jaw supported by means of elastic elements connected to the top and bottom of the jaw and one rigid jaw. The rigid and moveable jaws are fastened by means of an axle at the top end and a rubber pad at the bottom end. Materials to be crushed are fed through the inlet and directed towards the contracting portion of the working chamber. The high frequency impacts of the movable jaw produced by the vibrator produce constant bending stresses in the material to be crushed so that the blocks, or materials of flat shape, are crushed quickly and easily without overloading of the working and driving components of the crusher.

U.S. Pat. No. 3,465,976 describes a crusher with two vibratory jaws interconnected from the sides by two shock absorbers having horizontally flat brackets with resilient elements squeezed therebetween; upper and lower brackets are secured to the side of one jaw and a third bracket is disposed therebetween. In vibrating jaw crushers described previously, crushing the materials is effected between two movable jaws performing oppositely directed horizontal vibrating motions caused by synchronously operating vibrators. These crushers, however, are very bulky. In addition, the great weight of their supporting frames necessitate mounting of the crushers on foundations. The use of massive supporting frames can not be avoided since the forces arising in the course of crushing are fully received by the frames due to hinge impact of the crushing jaws to the supporting frames. Further, since the linkage between the crush plate, jaw and vibrator is a rigid one, all loads such as inertia, disturbing and elastic forces, and impact pulses are taken up by the vibrator, which significantly reduces the service life of the bearings. The jaw crusher of U.S. Pat. No. 3,465,976 was designed to overcome this disadvantage and specifically to insure that impact pulse would not be transmitted directly to the vibrators. This is achieved by interconnecting the movable jaws from the sides by means of shock absorbers resting against the supporting frame of the crusher. This apparatus also has a synchronizing device having toothed gears and flexible couplings.

U.S. Pat. No. 2,999,651 describes a rock crusher having a resilient jaw suspension arrangement which is very efficient in operation and minimizes noise and vibration. The jaw suspension structure is entirely spring mounted and contains no direct pivotal mountings which may be subject to wear. Each jaw is vibrated by a simple eccentric weight, the weights being driven in proper synchronization by a common source, i.e., a gear box.

A well known process for crushing materials is disclosed in U.S. Pat. No. 4,588,137. This process comprises the continuous feed of materials into a crushing chamber formed by two crushing bodies, with the pendicular oscillations imparted to one of the crushing bodies by means of an out-of balance rotating weight. The oscillations provide for the disintegration of the fed material when the bodies move toward each other, and discharge of the crushed materials when the bodies move away from each other. The reduction ratio of this process is slightly higher than that of previously used processes since the degree of material layer deformation is determined by the force developed by the driving out of balance weight, rather than the discharge clearance, or the drive's eccentricity, as in the previous analogous art. However, the reduction ratio is still low due to the limited crushing force since the driving weight is carried only by a single movable crushing body. Further a lack of any means to restrict shifting of the moveable body results in impact of the crushing bodies thereby reducing reliability of the apparatus.

U.S. Pat. No. 4,756,483 discloses another crushing process which comprises the continuous feed of material to the crushing chamber formed by two crushing bodies having antiphase alternating motion resulting from out-of-balance weights rotating in unison. Again, the materials are crushed as the bodies move toward one another and discharged from the chamber when the bodies move away from each other. However, in this process, the necessity to enforce the unison rotation of the out-of-balance weights requires a special reduction gear subject to frequent dynamic shocks resulting from changes in the acceleration of the rotating bodies. Further, the approach velocity of the crushing bodies is slowed down in the final phase of their convergence which decreases the crushing action because of lost kinetic energy and lowers the reduction ratio. The lost kinetic energy is absorbed by the means restricting the bodies' movement thus leading to energy loss due to hysteresis. Accordingly, sufficient potential necessary for the backward motion of the crushing bodies is not stored. In addition, the crushing rate of this process is reduced due to the lack of forced discharge of material from the crushing chamber which results from the absence of free alternating vertical motion of the crushing bodies.

In the present invention, a new process for crushing materials is provided. This crushing process has an increased reduction ratio and crushing rate. Further, this process require less power and provides a simplified crusher which has increased reliability.

SUMMARY OF THE INVENTION

An object of the present invention is to provide a process for crushing materials which comprises feeding the materials to be crushed between two crushing jaws having a crushing force which is controlled by a means capable of providing synchronous vibration of each crushing jaw with respect to each other.

BRIEF DESCRIPTION OF THE FIGURES

In FIG. 1*a,* the jaw crusher is depicted in a first position wherein the crushing bodies are in close proximity to one another so that materials are being crushed. In FIG. 1*b,* the jaw crusher is depicted in a second position wherein the crushing bodies are apart. As indicated by the upward arrows, as the crushing bodies move apart they also move upward to provide additional momentum to the crushed materials being discharged from between the crushing bodies.

DETAILED DESCRIPTION OF THE INVENTION

Figure 1A:
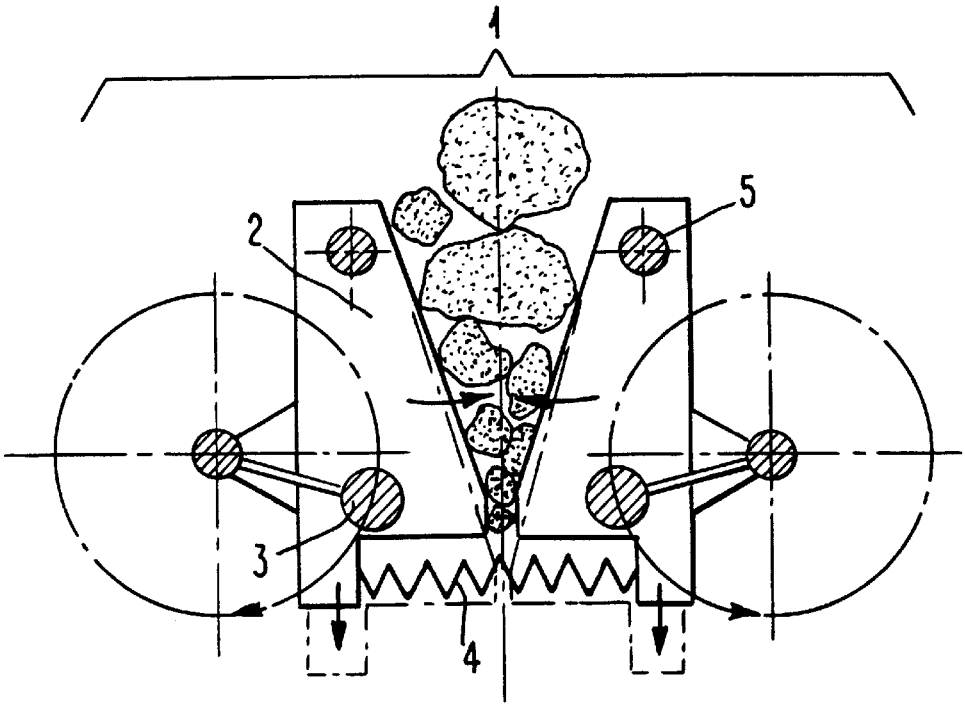
FIGS. 1*a* and 1*b* provide schematic diagrams of a preferred embodiment of a jaw crusher which can be used in the process of the present invention.

The present invention provides a new process for crushing materials which has an increased reduction ratio and crushing rate, while consuming less power and having a crusher which is simpler to operate and more reliable than conventional crushers and processes of crushing materials. These results are achieved using a jaw crusher 1 as exemplified in FIG. 1*a* wherein the crushing bodies 2 move toward each other at an increasing velocity until a minimal guaranteed clearance remains between them in the discharge area of the crushing chamber, with their velocity reaching its peak at the point of closest convergence. A locking in step of the out-of-balance weight 3 rotation is provided by introduction of resilient ties 4 linking the crushing bodies 2 whose axes of oscillation 5 impart a vertical alternating motion; the material is discharged from the crushing chamber as the axes 5 move upward, opposite to the flow of discharged material, thereby providing the material with an increased velocity as the axes 5 move downward.

Any system of interacting bodies tends to consume the minimum amount of energy. If a system is at rest or in uniform motion, the energy it consumes is minimal in comparison to a system where the interacting bodies perform uncoordinated or chaotic movements. Prior art methods have used gears to enforce a kinematic locking step for uniform motion. However, this gear system is subject to frequent dynamic shocks from the movement of the crushing bodies which significantly reduces the reliability and longevity of the gears. In the present invention, however, coordination of the interaction between bodies of the system is facilitated by a means capable of providing synchronous vibration of each crushing jaw. In a preferred embodiment, this means comprises resilient ties. Such resilient ties may comprise springs or torsion bars. The use of resilient ties between the crushing bodies provides the process of the present invention with the dynamic self-locking of rotating weights and locked antiphase oscillations of the crushing bodies. Further, these resilient ties store the oscillation energy of the crushing bodies and provide accumulated potential energy back to the crushing bodies at the moment of their closest convergence.

These advantages to the process of the present invention are achieved through the appropriate selection of the velocity of the rotating weights, the moment of inertia of the crushing bodies and the rigidity of the resilient ties. Such selections can be routinely made by those of skill in the art in accordance with the following calculations.

Figure 2:
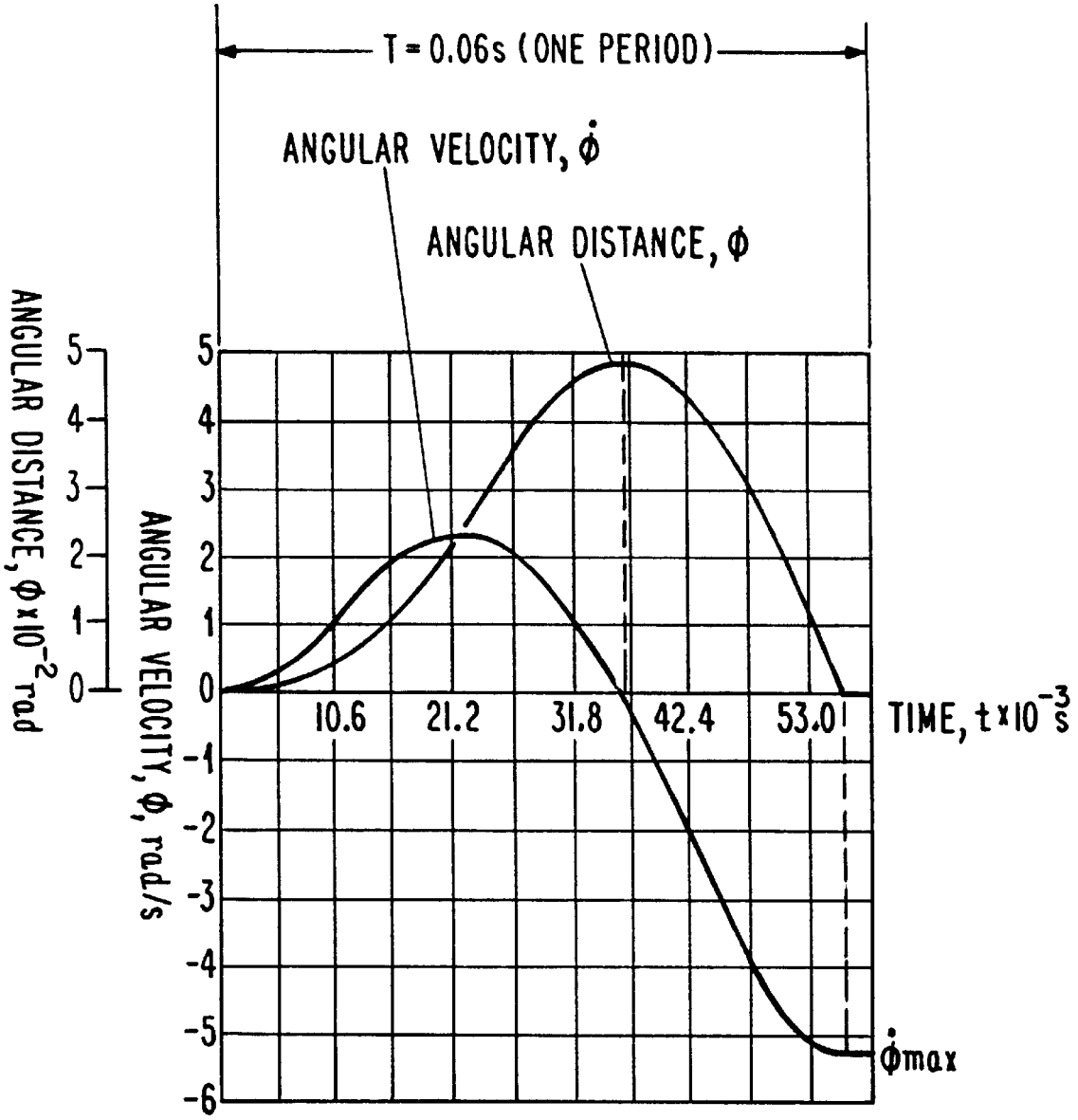
FIG. 2 provides a linegraph showing the angular distance and the angular velocity of the crushing bodies as functions of time.

The maximum angular velocity, Vmax, at the moment of impact with materials to be crushed, provides the greatest kinetic energy, T, of the body. This can be translated into the energy of material disintegration by the following formula:

$$\frac{T_{max} = I_{max}\Omega^2}{2}$$

wherein I equals the moment of inertia of the body with respect to the oscillation axis. FIG. 2 presents the angular velocity and angular distance traveled by the body as functions of time over one oscillation period. Accordingly, velocity reaches its peak at the moment when the bodies impact with the material to be crushed. Thus, the crushing efficiency of the present process is significantly greater than that of the prior art wherein the velocity is equal to zero at the moment of closest convergence.

In a preferred embodiment, the crushing rate of the process of the present invention is further increased by imparting additional velocity to the materials as they undergo crushing. In a preferred embodiment, a means for expanding the range of motion of the crushing bodies is attached at the top of each crushing body. By "expanding the range of motion" it is meant that the bodies can move both horizontally and vertically. Horizontal movement allows for the accommodation of larger materials to be crushed as the amount of space between the two bodies is increased. Vertical movement allows for the downward motion of the bodies during crushing and the upward motion of the bodies at the moment of discharge of crushed materials which increases the relative distance traveled by the material during one cycle.

The total distance, H, traveled by material in the course of its discharge is a sum of the free-fall distance $$\frac{gt^2}{2}$$

the distance traveled by material with initial velocity (v,t), and the relative displacement of material (S) in the course of a crushing cycle. Accordingly, the total distance of the falling material, also referred to as the height of the prism of the falling material, will be:

$$H = \frac{gt^2}{2} + vt + S$$

wherein t is the time of the opening of the crushing bodies. Processes in current use have a distance or height of prism determined only by the gravitational forces on the crushed materials. In contrast, the process of the present invention provides additional downward forces which increase the throughput of the jaw crusher.

Figure 1B:
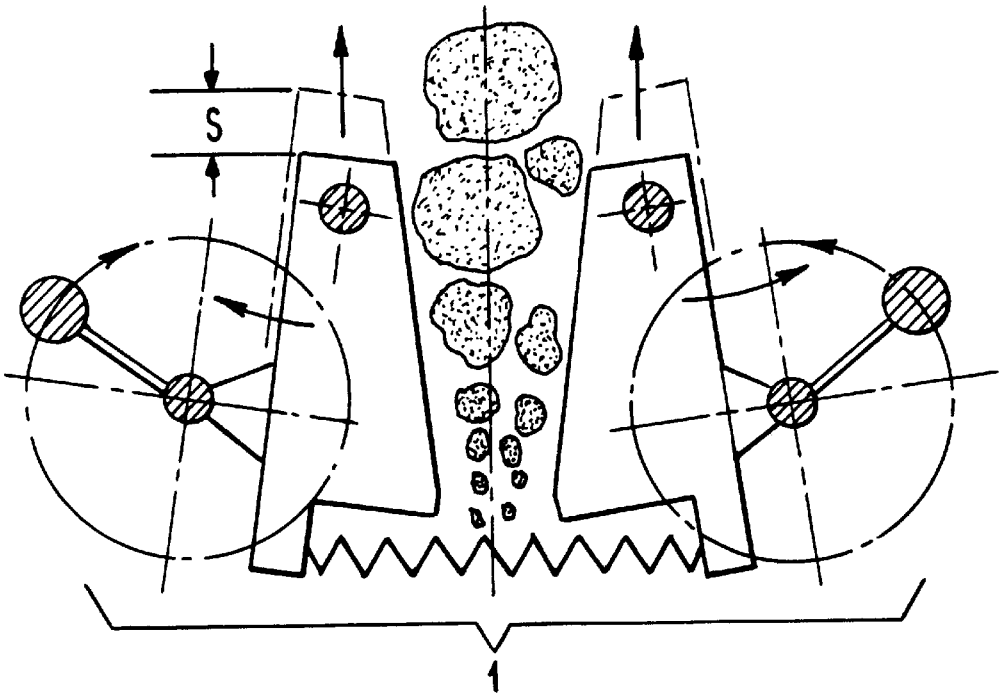

FIGS. 1*a* and 1*b* provide schematics of the jaw crusher at two moments in the cycle of the crushing process of the present invention. FIG. 1*a,* shows the moment when the material is being crushed. FIG. 1*b* shows the moment when the crushed material is discharged from between the crushing bodies. As is shown in FIGS. 1*a* and 1*b,* at the moment of crushing (FIG. 1*a*), the crushing bodies are converging, and the two bodies move downward imparting to the materials clamped between the two bodies a velocity directed toward discharge. At the moment of discharge, as shown in FIG. 1*b,* the crushing bodies move away from each other and the crushed material is discharged while the crushing bodies move upward by a distance S.

Accordingly, the impact disintegration of materials by the process of the present invention results in reduced power consumption, since it requires less energy to crush brittle materials by shock as compared to static compression.

Comparisons of the process of the present invention with a well known process of the prior art were performed. Using the process of the present invention, it was found that 92.7% of the finished product was finer than 3 mm and that no coarse classes were in the product. In contrast, the well known process yielded a coarse product. Further, the reduction ratio of the process of the present invention was increased by a factor of 2.6 as compared to conventional processing and the crushing rate was 1.3 times higher. In addition, less electrical power per ton of crushed product was consumed. These comparisons were performed at equal frequencies of jaw oscillation and equal forces of the out-of-balance weights.

The following nonlimiting examples are provided to further illustrate the present invention.

EXAMPLES

Example 1

Comparison of Crushing Processes

Lumps of nickel-copper ore of 100 mm size were crushed using the process of the present invention wherein the maximum velocity of the crushing bodies occurs at the moment of closest convergence. Similar lumps of nickel-copper ore were crushed using a known process wherein the crushing bodies have zero velocity at the moment of closest convergence. The following Table 1 provides results from this comparison.

TABLE 1

| CRUSHING | PARTICLE SIZE DISTRIBUTION OF THE CRUSHED PRODUCT, % | | | | | | | REDUCTION | CRUSHING RATE | POWER CONSUMP. |
|---|---|---|---|---|---|---|---|---|---|---|
| PROCESS | +10 | −10 + 7 | −7 + 3 | −3 + 2 | −2 + 1 | −1 + 0.5 | −0.5 | RATIO | tn/hr | kw hr/tn |
| 1. Claimed Process | — | — | 7.3 | 15.7 | 20.8 | 12.2 | 44.0 | 16.5 | 1.3 | 0.26 |
| 2. Known Process | 4.85 | 10.7 | 37.35 | 14.25 | 8.75 | 4.85 | 15.0 | 6.3 | 1 | 0.62 |

What is claimed:

1. A process for crushing materials comprising feeding materials to be crushed between two crushing jaws, said crushing jaws having a crushing force controlled by a means capable of providing synchronous vibration of each crushing jaw with respect to each other so that the crushing jaws move toward each other at an increasing velocity which reaches its maximum at a point of closest convergence of the crushing jaws; moving the crushing jaws toward each other at an increasing velocity which reaches its peak when the jaws impact with the materials to be crushed; moving the crushing jaws upward vertically; and discharging the crushed materials.

2. The process of claim 1 wherein said means comprises an elastic resilient tie.

3. A process of crushing materials by a crushing force created by two crushing jaws, each crushing jaw having a top portion and bottom portion, comprising feeding materials to be crushed between the top portion of the two jaws; moving the crushing jaws toward each other at an increasing velocity which reaches its peak when the jaws impact with the materials to be crushed; and moving the crushing jaws upward vertically so that the materials to be crushed drop through the crushing jaws to the bottom portion by gravitational force, said crushing jaws being connected to each other at the bottom portion by a means which controls the crushing force and provides for synchronous vibration of each crushing jaw with respect to each other so that the crushing jaws move toward each other at an increasing velocity which reaches its maximum at a point of closest convergence of the crushing jaws, and said top portion of each jaw having a means capable of providing an expanded range of motion.

* * * * *